US005383411A

United States Patent [19]

Tomaka et al.

[11] Patent Number: 5,383,411

[45] Date of Patent: Jan. 24, 1995

[54] COMBINATION TRAY, BED TRAY AND BATHROOM TRAY

[76] Inventors: Leonard P. Tomaka, #4817 175 E. Delaware Pl.; Larry M. Dreyfus, #4819 175 E. Delaware Pl., both of Chicago, Ill. 60611

[21] Appl. No.: 37,900

[22] Filed: Mar. 26, 1993

[51] Int. Cl.[6] ..... A47B 3/00

[52] U.S. Cl. ..... 108/129; 108/132

[58] Field of Search ..... 108/132, 133, 131, 130, 108/129, 43, 42, 11, 12; 297/423.41; 248/439, 170

[56] References Cited

U.S. PATENT DOCUMENTS

| | | | |
|---|---|---|---|
| 337,988 | 3/1886 | Palmer | 248/439 X |
| 3,123,022 | 3/1964 | Huddleston | 108/129 |
| 3,271,075 | 9/1966 | Good | 108/129 X |
| 4,383,488 | 5/1983 | Macho et al. | 108/129 |
| 4,463,826 | 8/1984 | Pearce | 108/129 X |
| 4,953,473 | 9/1990 | Tomaka et al. | 108/129 X |
| 5,109,778 | 5/1992 | Berkowitz et al. | 248/439 X |
| 5,259,305 | 11/1993 | Korb | 108/129 |

*Primary Examiner*—Jose V. Chen

*Attorney, Agent, or Firm*—Dressler, Goldsmith, Shore & Milnamow, Ltd.

[57] ABSTRACT

This relates to a tray assembly that can serve the of a conventional tray, a bed tray, or a bathtub tray. To accomplish this, the tray is provided with legs. When it is to be used as a conventional tray, the legs are merely folded underneath the tray. If the tray is to be used as a bed tray, the legs are moved to a slightly overcenter position to support the tray in an elevated position. To use the tray as a bathtub tray, the legs are returned to the folded position beneath the tray and are designed to move horizontally outwardly to extend the length of the tray so that it can be located on the sides of the bathtub.

11 Claims, 3 Drawing Sheets 10
12
14
18
20
22
24
26
28
32
34
36
38
40
42
44
46
48
50
54
60

FIG. 4
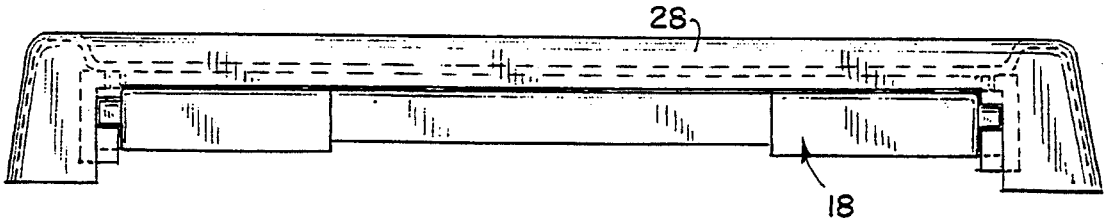
FIG. 5
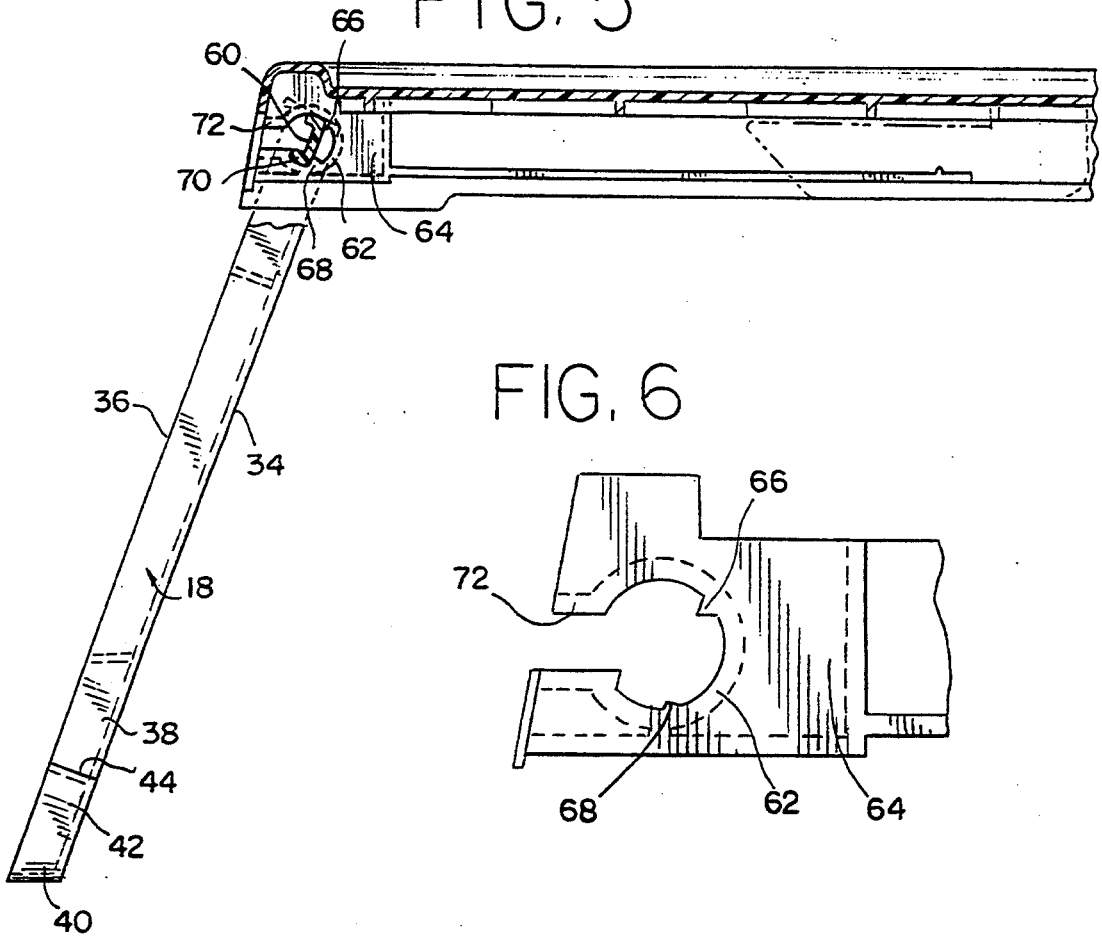
FIG. 6
FIG. 7
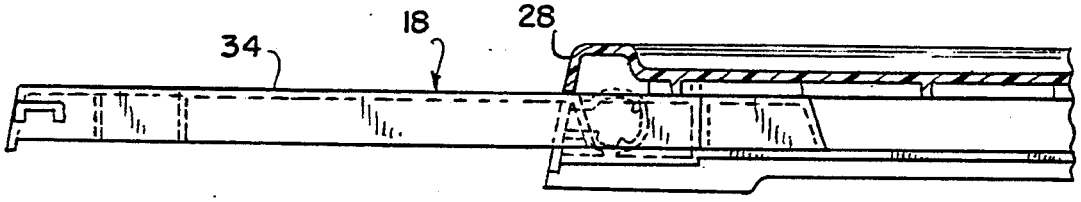

COMBINATION TRAY, BED TRAY AND BATHROOM TRAY

FIELD OF INVENTION

This invention relates to a tray assembly that can serve many functions. The tray assembly can function simply as a tray for carrying and/or serving various items, as a bed tray supported on vertically disposed legs, or a tray to be used in a bathroom whereby extensions are provided to support the tray relative to the sidewalls of a bathtub.

BACKGROUND OF THE INVENTION

Foldable trays to serve from or use in bed have been readily available in various sizes and shapes. There has also been a combination tray that has been usable as both a bed tray and a bathtub tray which while satisfactory is of a relatively complex construction. Such a tray is illustrated and described in U.S. Pat. No. 4,953,473, issued Sep. 4, 1990, in the names of the inventors of the instant invention. This type of tray performs the multiple functions of a conventional tray, a bedroom tray and a tray for use in a bathtub, but employs a large number of parts and requires different components to permit its multiple uses. For example, in the aforementioned tray, there are legs provided that are foldable underneath the tray and can be pivoted outwardly to convert the tray into a bedroom tray. However, if it is desired to use the tray as a bathroom tray, separate handles are provided that are made of wire, which handles are slidably mounted relative to the tray so that they can be moved outwardly and disposed on the sidewalls of a bathtub. The aforementioned design does not provide for additional tray space since the handles are merely wire frame members that are employed to provide for the elongated construction that can be supported on a bathtub.

SUMMARY OF THE INVENTION

The present invention provides for a unique and novel tray wherein there are provided leg portions that can be placed in a folded position wherein the tray will serve its normal function and, if desired, the legs can be unfolded into a generally vertical position to allow the tray to function as a bed tray. When it is desired to utilize the tray in a bathtub, the legs are folded back into position underneath the tray and are slidably supported to allow them to move longitudinally outwardly relative to the main tray portion to extend the length of the tray so it can be supported on the sidewalls of a bathtub. The legs of the tray, when folded, are disposed in guideways to guide the legs while being moved in a horizontal direction and the tray and legs are provided with interlocking stop means to limit the outward movement of the legs relative to the main tray portion. The legs and guide means are designed so that when the tray legs are moved inwardly under the main tray portion by applying a longitudinal force to the legs, the legs are no longer supported by the guideways. Thus, the legs that are pivotally mounted relative to the tray when in the folded position can then be pivoted downwardly into an overcenter position to where the legs will provide support for the tray. When the legs are in their horizontal position, springs are provided to normally retain the legs in position within the guide means so that the legs will not inadvertently move out of its horizontal position toward the vertical position.

As previously mentioned, there is provided an interacting pivot mechanism including a stop means between the leg portions and the tray body to permit the legs to pivot relative to the tray. The legs and tray frame include an interlocking stop means so that the legs that are moved to the slightly overcenter position will be retained in such position to support the tray in a vertically spaced relationship. It requires an application of a slight pressure to overcome the stop means to permit the leg to be moved back into the horizontal position underneath the tray.

Thus, it can be seen that there is provided a very simple tray construction in which with the legs located in position underneath the tray a conventional tray is provided that can be used as a snack tray, a picnic tray, or any other tray from which it is desired to serve. By moving the tray legs slightly inwardly to where the legs are free of a guide assemblage, the legs can be pivoted down into an overcenter, generally vertical position in which they will be retained. They will be held in this position by stop means formed within the tray structure which is engaged by lugs located on the legs.

When it is desired to convert the tray into a bathtub tray, the legs are moved back into the horizontal position and they are free to be moved outwardly within the guideway provided for the legs until the legs engage a shoulder that is formed in the underside of the tray which limits the outward longitudinal movement of the legs. The rotation of the tray legs into a horizontal position places the lugs that normally served as one part of the pivot hinge construction in a position to permit horizontal movement of the legs relative to the tray. The longitudinal movement of the legs in an outwardly direction relative to the tray depends on the width required to allow the tray to be supported on a bathtub.

BRIEF DESCRIPTION OF THE DRAWINGS

The invention will now more fully be described in connection with the accompanying drawings in which,

- FIG. 4 is an end view showing the leg disposed under the tray;
- FIG. 5 is a cross-sectional view illustrating one end of the tray with the leg in the vertical overcenter open position;
- FIG. 6 is an enlarged view of a plate defining a circular section in which the leg pivoting mechanism is located;
and
- FIG. 7 shows a cross-sectional view of the tray with the leg being horizontally extended to serve as a bathtub tray.

DETAILED DESCRIPTION OF THE INVENTION

Figures 1, 2:
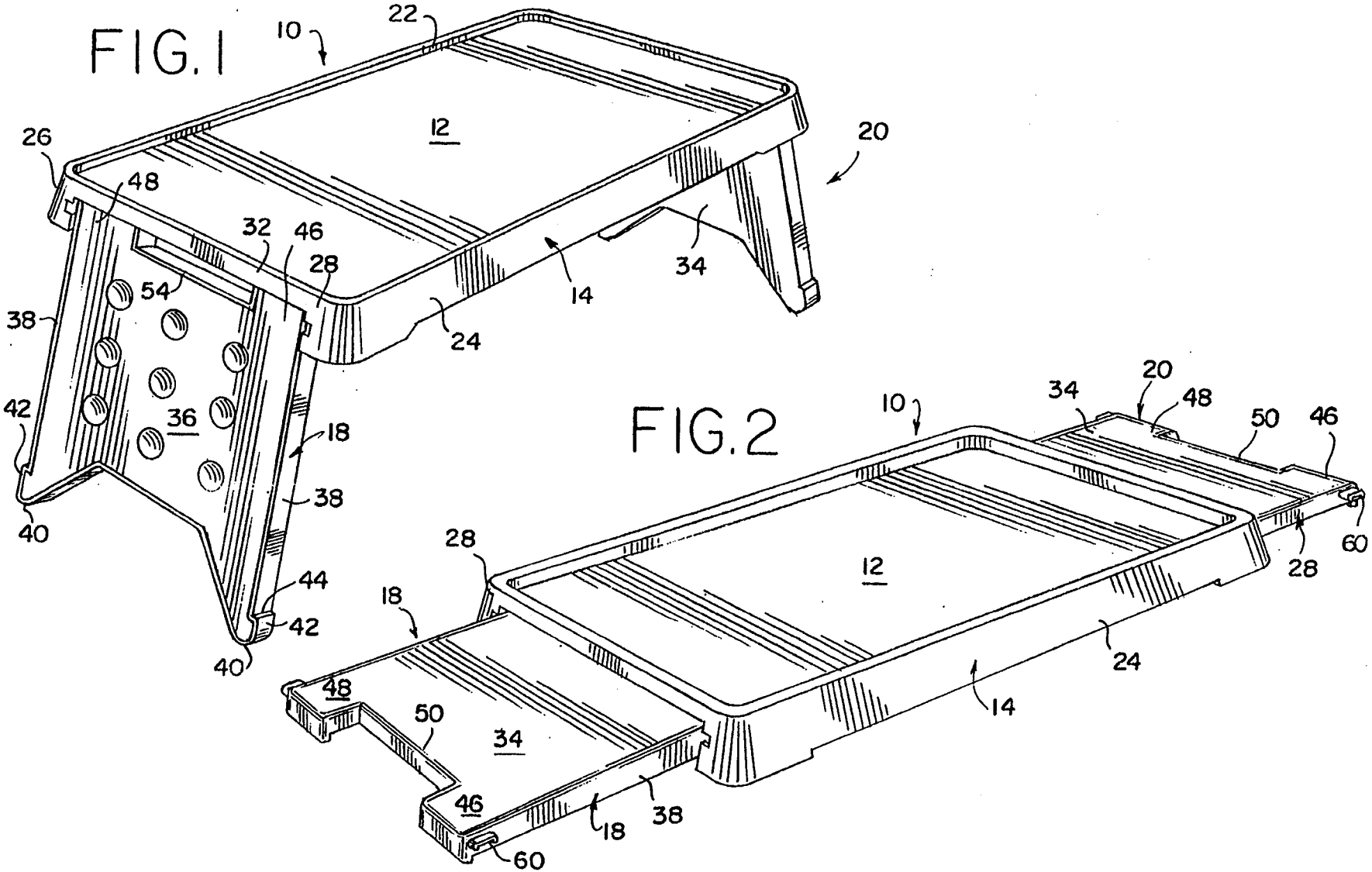
- FIG. 1 is a perspective view of a tray shown as a bed tray, with the legs in the generally upright position to vertically support the tray.
- FIG. 2 illustrates a perspective view of a tray with the legs located in a horizontal position under the tray and shown extended to serve as a bathtub tray.
Figure 3:
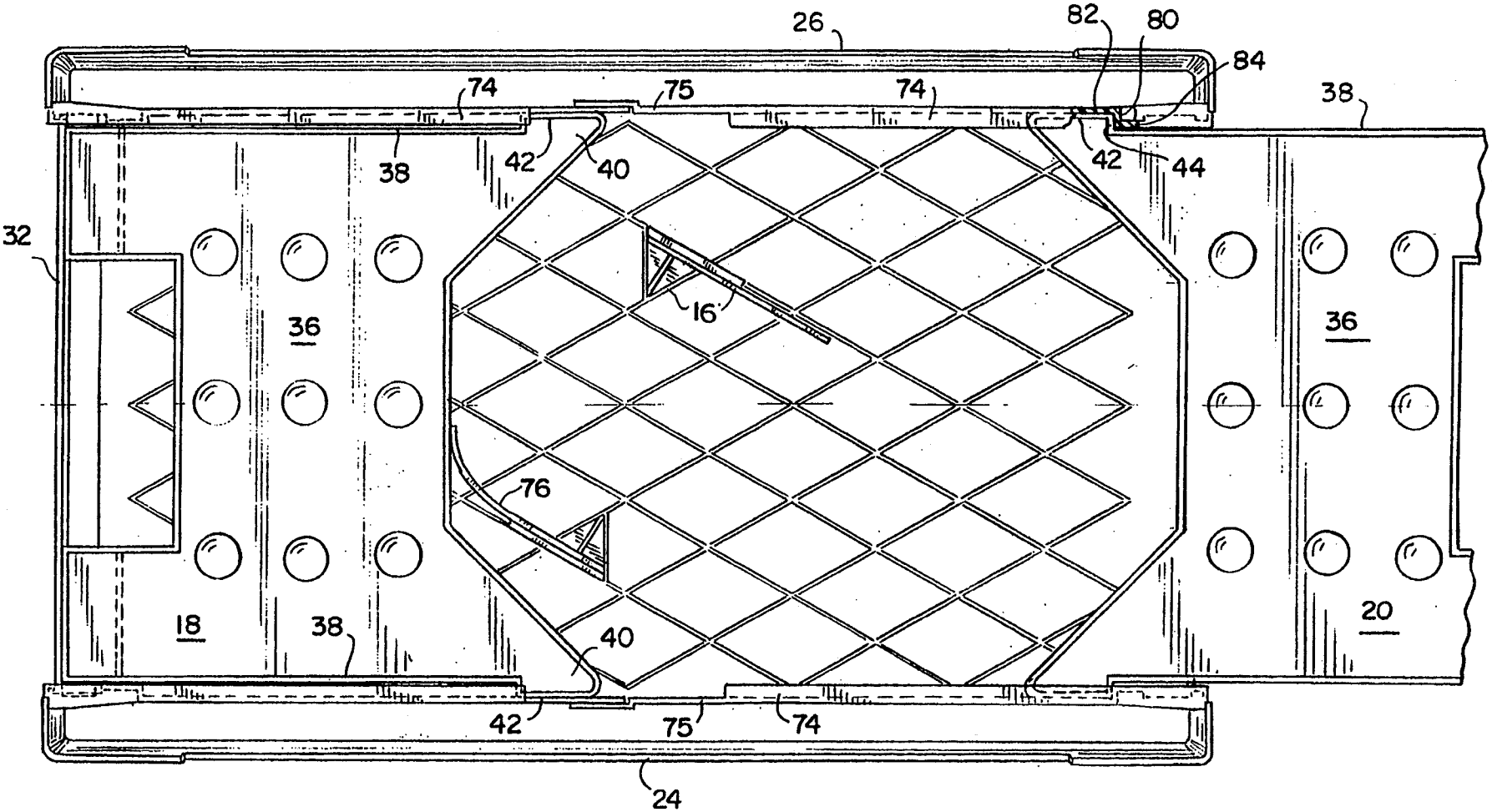
- FIG. 3 is a bottom view showing on the left hand side the folded leg located completely underneath the tray and the leg on the right-hand side shown in the extended position.

Referring first to FIG. 1, there is shown the tray assembly 10 consisting of the basic tray section 12 that includes a peripheral skirt 14. As shown in FIG. 3, the tray 12 is rigidly enforced by a grid assemblage 16 secured to the undersurface of the tray 12. The tray assembly 10 is shown as a bed tray, with the legs 18, 20 in a slightly overcenter position to retain the tray in the illustrated elevated position. The tray 12 also includes an upwardly extending peripheral lip 22 that serves as a border for the tray. In the illustrated embodiment, the tray is made of a plastic material, but, of course, the tray assemblage per se is not limited to being made of any particular material.

The tray includes longitudinally extending walls 24, 26 and transversely extending end walls 28, 30. The end walls 28, 30 define handles 32 whereby the tray assemblage 10 can be held and carried to wherever desired.

The legs 18, 20 are identical and thus only one will be described in detail. Also, the pivotal mounting of the legs as well as the horizontal guide assembly for the legs at each end of the tray are identical and thus only that included at one end will be described in detail.

Each leg includes an inner leg surface panel 34 which when in a horizontally extending position, forms an extension of the tray as illustrated in FIG. 2. The outer panel of the leg consists of a decorative panel 36 that can be connected to the frame of the leg in any conventional manner. The leg is initially molded in plastic including the inner panel 34 and peripheral flanges. The flanges include elongated sidewall sections 38 leading to foot portions 40 that form the supporting portions of the legs. Each of the foot portions 40 includes a short section 42 that is outwardly spaced from the indented sidewall sections 38. The sections 38 and 42 are joined by a short section 44 that performs a stopping function to be described hereinafter. The upper portion of the legs, as shown in FIG. 1, includes projections 46, 48 between which is located a handle portion 50 that can be gripped to move the legs 18, 20 longitudinally relative to the tray 12.

The legs 18, 20 are pivotally mounted relative to the tray 12 to permit the legs to be moved from the horizontal position wherein they are located under the tray within the skirt portion 14 thereof to the slightly overcenter position shown in FIG. 1. The pivotal connection for the legs is shown in detail in FIG. 5. Specifically, the upper ends of the leg include tabs 60 that extend outwardly from both wall portions 38 of the legs 18, 20 adjacent the projections 46, 48. When the legs are folded under the tray, the tabs 60 are located in a generally horizontal position as shown in FIG. 5 within a generally circular section 62 formed in a longitudinally extending relatively short flange 64 depending from the top wall on both sides at the ends of the tray. The circular section 62 in plate 64 is shown in enlarged detail in FIG. 6.

The transversely spaced generally circular sections 62 define shoulders 66, 68 that serve as stops when the legs are moved downwardly to the overcenter position as shown in FIG. 5, which precludes further pivotal movement of the leg 18 and thus locks the legs in the bed tray position. In order to move the legs to the position shown in FIG. 5, the tab 60 rides over the shoulder 68 and comes to rest in the groove 70 and the upper portion of the tab 60 abuts the shoulder 66. In order to return the leg to the horizontal position, the leg 18 is moved counterclockwise, as shown in FIG. 5, with sufficient pressure to force the tab 60 over the shoulder 68 and allow the tabs to be returned to the horizontal position. It is to be noted that when the legs are returned to the horizontal position, the tabs are located in a horizontal position, which permits the tabs to be moved horizontally out of the slot 72 and thus permits outwardly horizontal movement of the legs to allow the tray to be used as a bathtub tray. While the tabs are shown as being channel-shaped, they can be elliptical or another suitable shape if desired.

As illustrated in FIG. 3, the legs 18, 20 are guided for horizontal movement under the tray by horizontally disposed flanges 74 located on both sides and at both ends of the tray. These flanges are secured to longitudinally extending transversely spaced walls 75 that depend from the tray surface 12. The flanges 74 are wide enough to overlap the wall portions 42 but not the wall portions 38 of the leg 18. When the legs are to be moved to the horizontal position, the foot projections 40 are pushed inwardly to a horizontal position outwardly of the horizontally extending flange portions 74 which serve as a guide when the legs 18, 20 are to be moved outwardly relative to the tray 12. The guide flange 74 is approximately the length of the wall portion 38. As can be seen in FIG. 3, when the leg 18 is placed in the horizontal position and spaced slightly inwardly of the inner edge of flange 74, leg 18 contacts a spring 76 that is secured to the grid 16. The spring consists of a spring blade that acts to resiliently bias the legs 18, 20 slightly outwardly to where the foot extensions 40 are located underneath the flange 74 and thereby the legs 18, 20 are retained in a horizontal position.

As aforementioned, when the legs are in a horizontal position, they are free to move horizontally since the lugs 60 are free to move horizontally out of the slot 72. Outward horizontal movement of the legs transforms the tray into a bathtub tray. The legs are moved outwardly, as shown in the right hand section of FIG. 3, until the section 44 of the foot projections 40 engages a stop wall 80 located at the juncture of the spaced wall sections 82, 84 of the wall 75 formed in the underside of the tray 12.

In summation, it can be seen that when one looks to FIG. 1, there is shown the bed tray 12 wherein the legs 18 and 20 have been moved into the overcenter position with the lug 60 located in the groove 70 and biased against the shoulder 68 as shown in FIG. 5 to retain the legs in the overcenter position. When it is desired to use the tray in a bathtub, the leg 18 is moved counterclockwise by forcing the tab out of the groove 70 into the horizontal position wherein the lugs 60 are horizontally located within the slot 72. Thus, the legs that are horizontally guided by the flanges 74 can be moved longitudinally outwardly relative to the tray 12, the requisite distance in order to move the legs into position to be supported above the sidewalls of a bathtub. It is to be noted that in this position, we now not only have the original surface area of the tray 12, but we also have the surface areas 34 of the legs 18, 20, with the result that you have an enlarged surface area on which you may place additional items.

Accordingly, it can be seen that we have a novel tray construction which can be in the first instance used as a simple tray with the legs in position underneath the tray and held therein. When it is to be used as a bed tray, the legs are moved to the slightly overcenter vertical position. When it is desired to use the tray in a bathtub, the legs are returned to the horizontal position and are positioned to be moved outwardly to engage the upper surface of sidewalls of a bathtub. The legs thus serve the function of extension arms to provide support for the tray on a bathtub, or as legs for the tray in a bed tray position. This is very novel, since there were no bed trays heretofore available that used the leg portions thereof to serve as the legs of a tray to position it as a bed tray or as extension arms to allow the tray to have an enlarged surface area and be used as a tray in a bathtub.

It is intended to cover by the appended claims all such modifications as fall within the true spirit and scope of the invention.

What is claimed is:

1. A combination serving tray, bed tray, and bathtub tray assembly which comprises:

a tray having a flat surface including longitudinally spaced end portions providing a serving surface for objects to be placed thereon, a support including a planar surface area for each of said end portions, interchangeable pivot and stop means provided at one end of each support and an adjacent end of said tray for permitting swinging of said support from a closed position underneath the tray, in which position the support is substantially parallel to the tray surface, downward into a vertical position and beyond into a slight overcenter, open position, in which position the support is generally upright and is restrained in such position to hold the tray at a predetermined height, and means located on the bottom of said tray for retaining and guiding the supports relative to the tray while in the closed position, but permitting outward movement of the supports relative to the tray surface to provide an additional serving surface and an extended length to permit the tray to be positioned on a support structure equal to the extended length of the tray provided by said supports.

2. A combination tray assembly as set forth in claim 1 in which the interchangeable pivot and stop means permitting swinging of each support from the tray includes a generally circular opening including stop means defined by the tray assembly and the adjacent support defines a lug extending outwardly from each side thereof which rotates within said circular opening to a position wherein it engages said stop means which prevents further pivotal movement of its respective support relative to the tray.

3. A tray assembly in accordance with claim 2 including guide channels secured to and disposed beneath said tray surface and the generally circular opening defines a slot portion whereby when the supports are disposed beneath the tray the lugs are free to move relative to the tray to permit the supports to be positively guided when they are extended out from beneath the tray to provide the extended tray length.

4. A tray assembly in accordance with claim 3 in which the tray and supports define interengaging stop means whereby outward movement of said supports relative to said tray is limited.

5. A tray assembly in accordance with claim 3 in which the underside of said tray is provided with spring means positioned to engage each of said supports when said supports are located under the flat surface portion of said tray to maintain said supports in said guide channels to retain said supports parallel to said flat surface and prevent them from moving out from underneath the bottom of said tray.

6. A tray assembly in accordance with claim 5 in which the spring means comprises a leaf spring connected to a reinforcing structure secured to said tray.

7. A tray assembly in accordance with claim 3 in which each of said supports defines a handle portion for moving said supports relative to said tray.

8. A combination serving tray, bed tray, and bathtub tray assembly which comprises:

a generally rectangular tray including longitudinal and transversely extending sidewalls, a combination support and serving section located adjacent the transversely extending sidewalls of said tray, interengaging pivot and stop means defined by one end of each of said support which includes an additional planar surface area sections and the adjacent transverse wall of said tray and the other end of the support section defining legs having outwardly extending feet portions whereby the support section is free to pivot relative to said tray from a position beneath said tray to a slightly overcenter position where it will be retained in said position to support the tray in an upright portion on said feet portions, channel members secured to the underside of the tray, said channel members being of a width and length to guide the feet portions of said support sections whereby when the support sections are moved parallel to the serving section a predetermined amount will extend beyond the channel sections, and means for biasing said feet portions underneath said channel members to retain the supports relative to said tray.

9. A tray assembly as set forth in claim 8 in which the interengaging pivot and stop means includes a lug secured to each side of said legs, which lug extends into a generally circular opening defined by a flange extending downwardly from said tray, the flange defines stop abutments which limit the movement of said lugs to retain the support in the overcenter position, but are sufficiently flexible to permit closing movement of said supports, said circular opening also defines a slot whereby the lugs can move out of said circular opening when the supports are in the folded position to permit the support sections to be extended so the tray can be used in a bathtub.

10. A tray as set forth in claim 9 in which the support sections are generally H-shaped and at one end are disposed the outwardly extending lugs with a handle portion therebetween and the other end defines the feet portions on which the tray is supported when the supports are in their generally upright position.

11. A tray assembly as set forth in claim 8 in which the means for biasing the support sections to position the feet portions beneath the channel members consist of a resilient leaf spring secured to a reinforcing structure formed integral with the undersurface of the tray.

* * * * *

UNITED STATES PATENT AND TRADEMARK OFFICE

CERTIFICATE OF CORRECTION

PATENT NO. : 5,383,411

DATED : January 24, 1995

INVENTOR(S) : Leonard P. Tomaka and Larry M. Dreyfus

It is certified that error appears in the above-indentified patent and that said Letters Patent is hereby corrected as shown below:

Column 5, lines 17 and 36, "interchangeable" should be --interengageable--.

Signed and Sealed this

Eighteenth Day of April, 1995

Bruce Lehman

*Attest:*

BRUCE LEHMAN

*Commissioner of Patents and Trademarks*

*Attesting Officer*